US008919636B2

(12) United States Patent
Bettinger et al.

(10) Patent No.: US 8,919,636 B2
(45) Date of Patent: Dec. 30, 2014

(54) COATED TWO-PIECE CONTAINER ASSEMBLY AND METHODS OF MAKING THE SAME

(71) Applicants: Charles E. Bettinger, Aledo, TX (US); Kerry D. Wall, Grapevine, TX (US); Keith A. Jackson, Gurnee, IL (US)

(72) Inventors: Charles E. Bettinger, Aledo, TX (US); Kerry D. Wall, Grapevine, TX (US); Keith A. Jackson, Gurnee, IL (US)

(73) Assignee: Packaging Corporation of America, Lake Forest, IL (US)

( * ) Notice: Subject to any disclaimer, the term of this patent is extended or adjusted under 35 U.S.C. 154(b) by 41 days.

(21) Appl. No.: 13/900,661

(22) Filed: May 23, 2013

(65) Prior Publication Data

US 2013/0334296 A1 Dec. 19, 2013

Related U.S. Application Data

(63) Continuation-in-part of application No. 12/497,260, filed on Jul. 2, 2009, now Pat. No. 8,448,843.

(60) Provisional application No. 61/079,019, filed on Jul. 8, 2008.

(51) Int. Cl.

| | |
|---|---|
| ***B65D 43/08*** | (2006.01) |
| ***B31B 1/62*** | (2006.01) |
| ***B65D 85/72*** | (2006.01) |
| ***B65D 5/32*** | (2006.01) |
| ***B65D 5/56*** | (2006.01) |
| ***B65D 5/02*** | (2006.01) |
| ***B65D 5/12*** | (2006.01) |
| ***B31B 1/00*** | (2006.01) |

(52) U.S. Cl.

CPC ..... *B65D 85/72* (2013.01); *B65D 5/326* (2013.01); *B65D 5/563* (2013.01); *B65D 5/029* (2013.01); *B65D 5/12* (2013.01); *B31B 1/00* (2013.01)

USPC ..... 229/125.19; 229/109; 229/122.3; 493/104; 493/114

(58) Field of Classification Search

USPC ..... 229/122.27, 122.3, 122.33, 109, 110; 206/386, 600; 493/102, 104, 114

See application file for complete search history.

(56) References Cited

U.S. PATENT DOCUMENTS

| | | | | |
|---|---|---|---|---|
| 371,159 | A | 10/1887 | Wright, Jr. | |
| 1,156,250 | A | 10/1915 | Scott | |
| 1,430,149 | A | 9/1922 | Bliss | |
| 1,631,521 | A * | 6/1927 | Crowell | 229/122.27 |
| 2,440,193 | A | 4/1948 | Davis et al. | |
| 2,745,591 | A | 5/1956 | Holt, Jr. | |
| 2,761,609 | A | 9/1956 | Arkin | |
| 2,766,923 | A * | 10/1956 | D'Esposito | 206/320 |
| 2,794,588 | A * | 6/1957 | George et al. | 229/125.16 |

(Continued)

*Primary Examiner* — Gary Elkins

(74) *Attorney, Agent, or Firm* — Nixon Peabody LLP

(57) ABSTRACT

A container assembly. The container assembly includes a tube portion having a plurality of sides formed from an inner fiberboard layer, an outer fiberboard layer, and at least one corrugated layer sandwiched therebetween, an internal surface of the inner fiberboard layer having a first generally water-resistant coating, the inner fiberboard layer extending around a bottom of the corrugated layer and being adhered to at least a portion of the outer fiberboard layer. The container assembly further includes a base portion including a bottom panel and a plurality of flaps extending from the bottom panel, the base portion including a second generally water-resistant coating, the plurality of flaps overlapping a portion of the plurality of sides. The plurality of flaps is adhered to respective ones of the plurality of sides by one or more continuous adhesive lines.

21 Claims, 7 Drawing Sheets

(56) References Cited

U.S. PATENT DOCUMENTS

| | | | | | |
|---|---|---|---|---|---|
| 3,055,568 | A | * | 9/1962 | Zalkind | 229/117.27 |
| 3,162,100 | A | * | 12/1964 | Rein et al. | 493/102 |
| 3,251,533 | A | | 5/1966 | Cohen | |
| 3,465,944 | A | | 9/1969 | Robinson | |
| 3,524,578 | A | | 8/1970 | Benezra | |
| 3,653,578 | A | * | 4/1972 | Wood | 229/122.33 |
| 3,832,827 | A | | 9/1974 | Lemelson | |
| 3,863,831 | A | | 2/1975 | Wozniacki et al. | |
| 3,907,194 | A | | 9/1975 | Davenport et al. | |
| 3,941,305 | A | * | 3/1976 | Chipp et al. | 229/125.13 |
| 4,042,164 | A | | 8/1977 | Croley | |
| 4,160,519 | A | | 7/1979 | Gorham | |
| 4,366,021 | A | | 12/1982 | van der Wal | |
| 4,409,776 | A | | 10/1983 | Usui | |
| 4,585,143 | A | * | 4/1986 | Fremow et al. | 206/386 |
| 4,641,488 | A | | 2/1987 | Garr | |
| 4,702,408 | A | | 10/1987 | Powlenko | |
| 4,718,597 | A | | 1/1988 | Bishop | |
| 4,746,011 | A | | 5/1988 | McNair, Jr. et al. | |
| 4,762,226 | A | * | 8/1988 | Gatton | 206/320 |
| 4,784,271 | A | | 11/1988 | Wosaba, II et al. | |
| 4,830,271 | A | | 5/1989 | Lau et al. | |
| 4,905,451 | A | | 3/1990 | Jaconelli et al. | |
| 4,917,289 | A | * | 4/1990 | Linnemann et al. | 229/109 |
| 5,000,372 | A | * | 3/1991 | Hollander et al. | 229/103.11 |
| 5,025,608 | A | | 6/1991 | Marchetti | |
| 5,027,581 | A | | 7/1991 | Kovacs | |
| 5,115,965 | A | | 5/1992 | Alepuz | |
| 5,314,557 | A | | 5/1994 | Schwartz et al. | |
| 5,351,849 | A | | 10/1994 | Jagenburg et al. | |
| 5,423,163 | A | | 6/1995 | Wendt | |
| 5,447,009 | A | | 9/1995 | Oleksy et al. | |
| 5,768,862 | A | | 6/1998 | Mauro | |
| 5,772,108 | A | | 6/1998 | Ruggiere, Sr. et al. | |
| 5,921,465 | A | | 7/1999 | Garton | |
| 5,938,108 | A | * | 8/1999 | Williams et al. | 229/109 |
| 5,941,452 | A | | 8/1999 | Williams et al. | |
| 6,095,409 | A | | 8/2000 | Tsai | |
| 6,138,903 | A | * | 10/2000 | Baker | 229/122.33 |
| 6,244,502 | B1 | | 6/2001 | Hollar et al. | |
| 6,893,528 | B2 | | 5/2005 | Middelstadt et al. | |
| 6,945,018 | B2 | | 9/2005 | Suolahti | |
| 7,458,502 | B2 | | 12/2008 | Habeger et al. | |
| 8,448,843 | B2 | * | 5/2013 | Bettinger et al. | 229/125.19 |
| 2005/0040063 | A1 | | 2/2005 | Churvis et al. | |
| 2007/0228129 | A1 | * | 10/2007 | Habeger et al. | 229/125.19 |
| 2007/0257094 | A1 | | 11/2007 | Jackson | |
| 2008/0023359 | A1 | * | 1/2008 | Churvis et al. | 206/386 |

* cited by examiner

COATED TWO-PIECE CONTAINER ASSEMBLY AND METHODS OF MAKING THE SAME

CROSS-REFERENCE TO RELATED APPLICATION

This application is a continuation-in-part application of U.S. patent application Ser. No. 12/497,260, filed Jul. 2, 2009, which claims the benefit of U.S. Provisional Patent Application No. 61/079,019, filed Jul. 8, 2008, which are both hereby incorporated by reference in their entireties.

FIELD OF THE INVENTION

The present invention relates generally to containers for retaining and protecting goods during shipment and methods for making such containers. In particular, the present invention relates to a two-piece, tray-formed shipping container assembly having a generally water-resistant coating(s) applied thereto.

BACKGROUND OF THE INVENTION

Corrugated fiberboard containers have been used for many years as shipping and storage containers for a large variety of products. Corrugated fiberboard generally refers to a multi-layer sheet material comprised of sheets of liner bonded to central corrugated layers of medium. Single-wall corrugated involves two sheets of liner bonded on alternate sides of one corrugated medium while double-wall corrugated involves three liners bonded alternatively to two corrugated mediums. Corrugated fiberboard containers may vary greatly in size and weight depending on the intended usage of the container.

The bottoms of existing single-piece containers are typically comprised of several flaps, each of which extends from a respective side of the container. The flaps are then attached to one another using an adhesive or other suitable means of attachment to form the bottom. The resulting "interrupted" bottom includes holes that may allow for the contents of the container—particularly liquid contents—to escape from the container. Additionally, the interrupted bottom is often prone to snagging and/or tearing a plastic liner that may be contained within the container. The interrupted bottom is also prone to being accidentally opened, or "blown-out," thereby unintentionally releasing the contents of the container.

The distribution of products in large containers is common in a wide variety of industries, ranging from automotive to food. Corrugated semi-bulk containers ("CBCs") are examples of containers common in the meat industry for storing and shipping beef, pork, and other animal products between processing facilities and from those processing facilities to customers.

Existing CBCs typically include a liner generally made of plastic (e.g., a "poly bag") inside of the CBC to assist in preventing leakage of fluids into the external environment or into the walls of the container, thereby weakening the container. The incorporation of poly bags into CBCs and other such containers is often associated with substantial labor and costs. Moreover, the generally leak-proof nature of such poly bags is often such that the poly bags are not easily biodegradable and can be undesirable from an environmental standpoint.

It would be desirable to create a container that addresses one or more of the above-described disadvantages.

SUMMARY OF THE INVENTION

According to one embodiment of the present invention, a container assembly is disclosed. The container assembly includes a tube portion including a plurality of sides formed from an inner fiberboard layer, an outer fiberboard layer, and at least one corrugated layer sandwiched therebetween. An internal surface of the inner fiberboard layer has a first generally water-resistant coating. The inner fiberboard layer extends around a bottom of the corrugated layer and is adhered to at least a portion of the outer fiberboard layer. The container assembly further includes a base portion including a bottom panel and a plurality of flaps extending from the bottom panel. The base portion includes a second generally water-resistant coating. The plurality of flaps overlaps a portion of the plurality of sides. The plurality of flaps is adhered to respective ones of the plurality of sides by one or more continuous adhesive lines.

According to one process of the present invention, a method of forming a container assembly is disclosed. The method includes adhering a first side of a tube portion to a second, opposing side of the tube portion. The tube portion is formed from an inner fiberboard layer, an outer fiberboard layer, and at least one corrugated layer sandwiched therebetween. The inner fiberboard layer includes a first generally water-resistant coating. The inner fiberboard layer extends around a bottom of the corrugated layer and is adhered to at least a portion of the outer fiberboard layer. The method further includes providing a base portion having a bottom panel. The bottom panel has a plurality of flaps extending therefrom. The base portion includes a second generally water-resistant coating extending from the bottom panel to at least a portion of the plurality of flaps. The plurality of flaps overlaps a portion of the plurality of sides. The method further includes placing the tube portion over the base portion. The method further includes folding the plurality of flaps along fold lines, the fold lines separating the plurality of flaps from the bottom panel. The method further includes attaching each of the plurality of flaps to a respective one of the plurality of sides of the tube portion by at least one continuous, generally horizontal adhesive line positioned along at least one of a lower portion of the tube portion and the flaps.

According to another embodiment of the present invention, a container assembly is disclosed. The container assembly includes a tube portion including a plurality of sides formed from an inner fiberboard layer, an outer fiberboard layer, and at least one corrugated layer sandwiched therebetween. The corrugated layer is shortened such that the inner and outer fiberboard layers are directly adhered to one another at bottom ends of the plurality of sides. The inner fiberboard layer includes a first generally water-resistant coating. The container assembly further includes a base portion including a bottom panel and a plurality of flaps extending from the bottom panel. The base portion includes a second generally water-resistant coating extending from the bottom panel to at least a portion of the plurality of flaps. The plurality of flaps overlaps a portion of the plurality of sides. The plurality of flaps is adhered to respective ones of the plurality of sides by one or more continuous adhesive lines.

The above summary of the present invention is not intended to represent each embodiment or every aspect of the present invention. This is the purpose of the figures and the detailed description which follow.

BRIEF DESCRIPTION OF THE DRAWINGS

Other advantages of the invention will become apparent upon reading the following detailed description and upon reference to the drawings in which.

Figure 1:
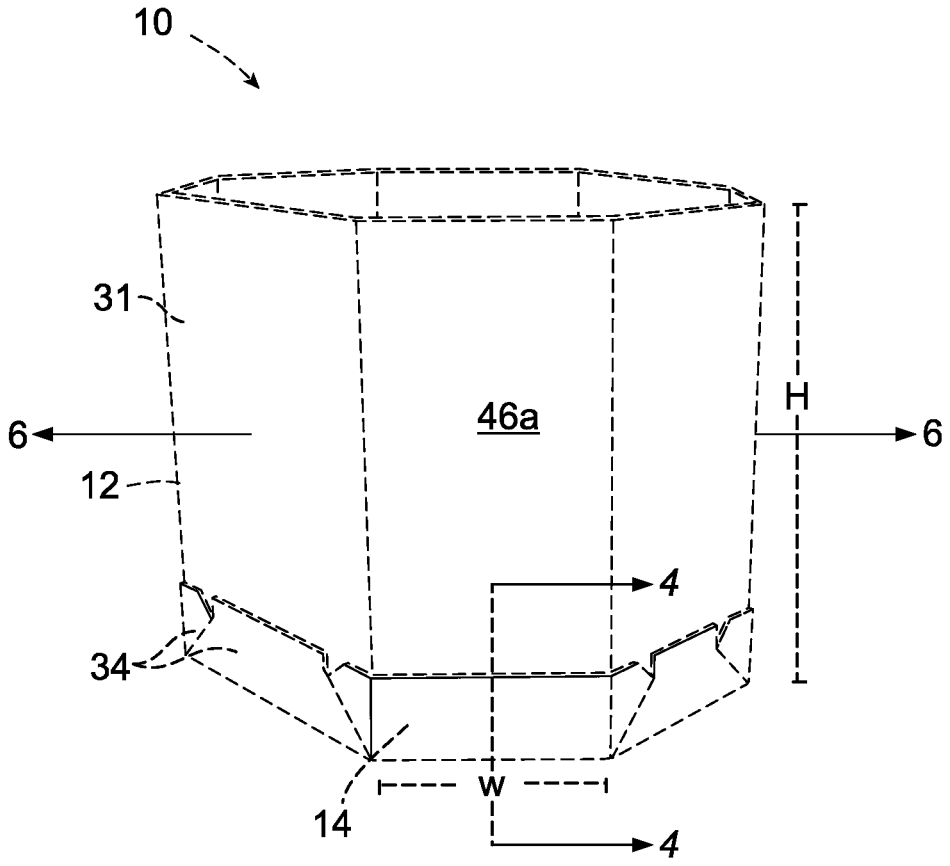
FIG. 1 is an isometric view of a container assembly according to one embodiment of the present invention.

While the invention is susceptible to various modifications and alternative forms, a specific embodiment thereof has been shown by way of example in the drawings and will herein be described in detail. It should be understood, however, that it is not intended to limit the invention to the particular forms disclosed, but, on the contrary, the intention is to cover all modifications, equivalents, and alternatives falling within the spirit and scope of the invention as defined by the appended claims.

DETAILED DESCRIPTION OF THE INVENTION

Turning now to FIG. 1, a container assembly 10 according to one embodiment of the present invention is shown. The container assembly 10 is adapted to hold contents being transported from a first location to a second location. The container assembly 10 has a tube portion 12 and a base portion 14. The tube portion 12 and the base portion 14 may include fiberboard. In the embodiments discussed herein, the tube portion and/or the base portion 14 are single-wall or double-wall corrugated fiberboards. In one embodiment, the maximum caliber of the base portion is about 3/16 inches.

In the illustrated embodiment of FIG. 1 the tube portion 12 and the base portion 14 each have an octagonal shape (i.e., eight sides). It is contemplated, however, that the tube portion 12 and the base portion 14 may have any suitable shape such as rectangular, square, hexagonal, other polygonal shapes, or the like. As such, the tube portion and the base portion may have any number of sides, e.g., greater than four. It is also contemplated that the width W and/or the height H of the sides may vary.

Figure 2A:
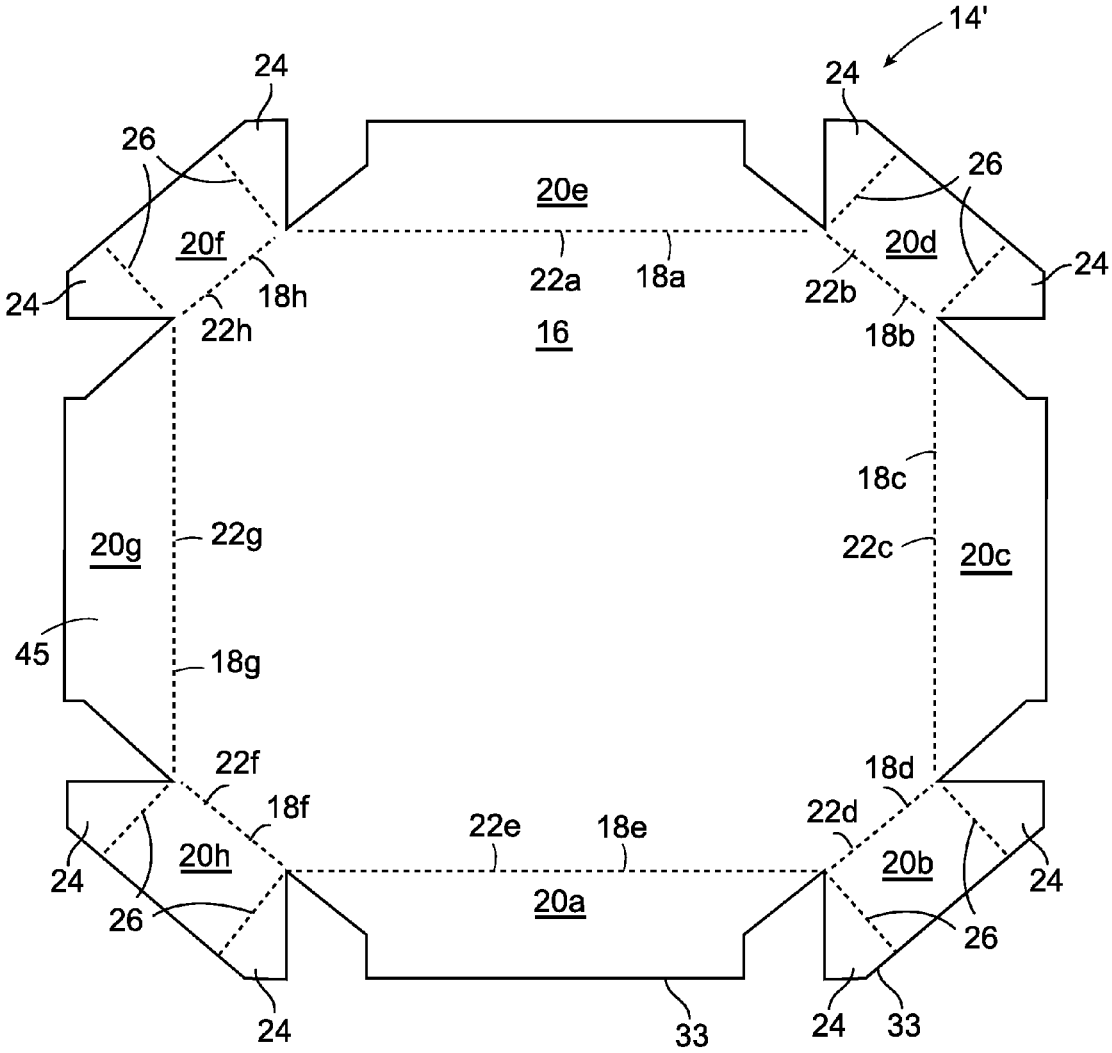
FIG. 2A is a plan view of a base blank for forming a base portion of FIG. 1.
Figure 2B:
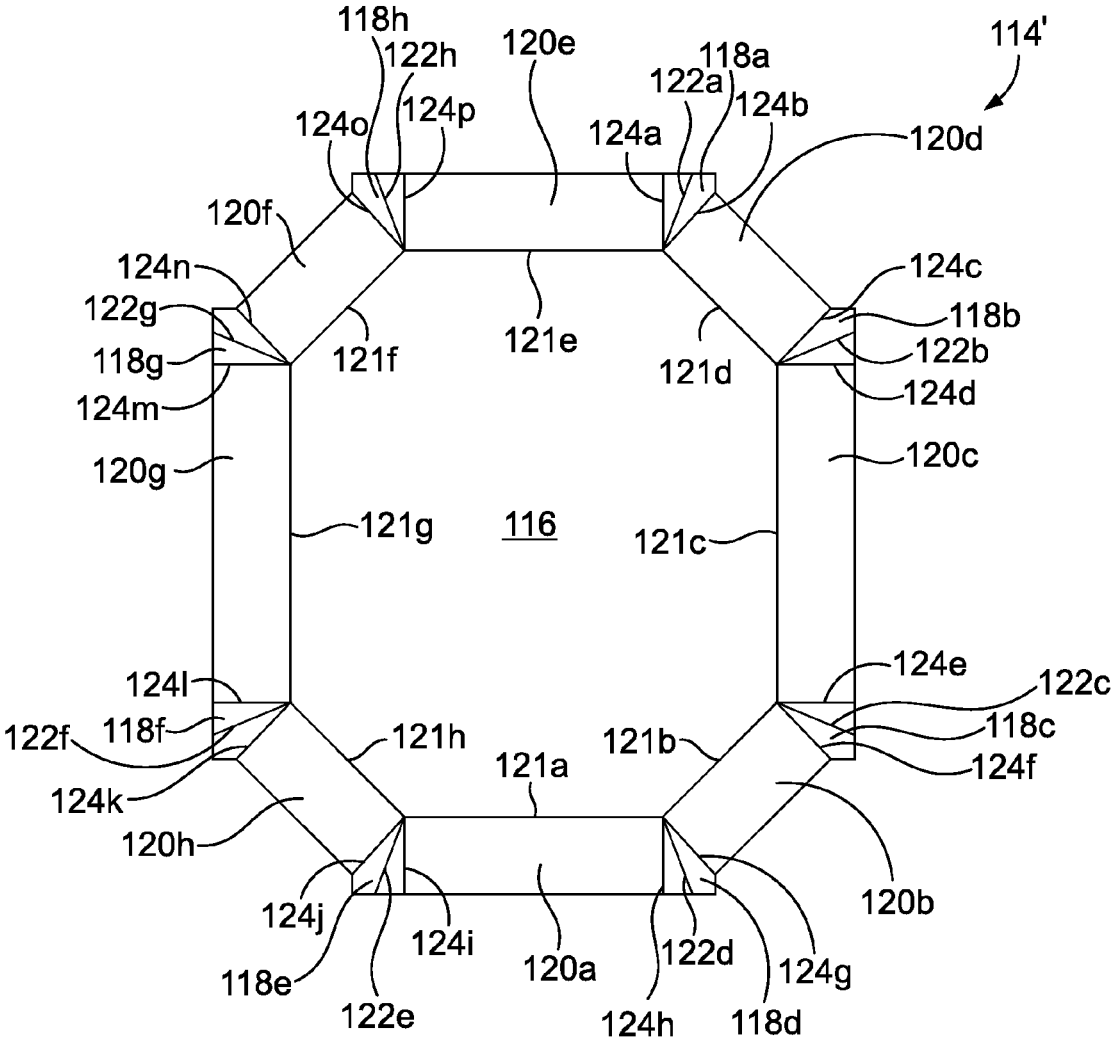
FIG. 2B is a plan view of a base blank for forming a base portion according to another embodiment.
Figure 3:
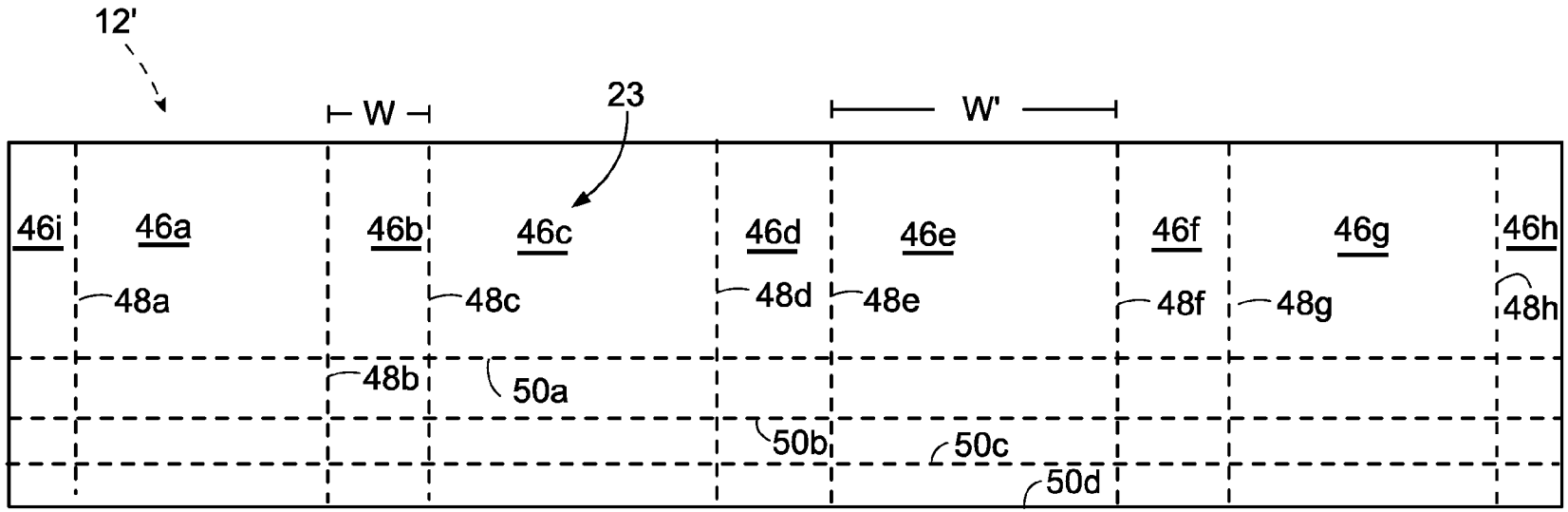
FIG. 3 is a plan view of a tube blank for forming a tube portion of FIG. 1.

Turning now to FIGS. 2A, 2B, and 3, plan views of base blanks 14', 114' and a tube blank 12', respectively, for the formation of the container assembly 10 of FIG. 1 are shown. Referring first to FIG. 2A, an interior side 45 of the base blank 14' is shown according to one embodiment. The base blank 14' includes a bottom panel 16 having a generally octagonal shape (i.e., eight sides 18*a-h*). The eight sides 18*a-h* include horizontal sides 18*a*, 18*e*, vertical sides 18*c*, 18*g*, and diagonal sides 18*b*, 18*d*, 18*f*, 18*h*. The bottom panel 16 includes eight flaps 20*a-h* extending from and integrated with each of the eight sides 18*a-h*. The flaps 20*a-h* are separated from the bottom panel 16 by respective fold lines 22*a-h*. The flaps 20*b*, 20*d*, 20*f*, 20*h* extending from the generally diagonal sides 18*b*, 18*d*, 18*f*, 18*h* of the bottom panel 16 include opposing tabs 24 extending therefrom. The opposing tabs 24 are separated from the remaining portion of the flaps 20*b*, 20*d*, 20*f*, 20*h* by fold lines 26.

FIG. 2B illustrates a plan view of a base blank 114' according to another embodiment. The base blank 114' is generally similar to the base blank 14' of FIG. 2A except that the base blank 114' further integrally includes a plurality of substantially V-shaped bellows panels 118*a-h*. Each of the plurality of bellows panels 118*a-h* is provided between a respective pair of adjacent flaps 120*a-h* such that the flaps 120*a-h* are webbed together. Each of the bellows panels 118*a-h* is connected to a respective adjacent flap 120*a-h* by a respective crease or fold line 124*a-p*. Additionally, each of the bellows panels 118*a-h* includes a crease or folding line 122*a-h* at the center of the V-shape. This webbed embodiment may be desirable for further ensuring the general water-resistance of the resulting container assembly.

Referring now to FIG. 3, an interior side 23 of the tube blank 12' for forming the container assembly 10 is shown according to one embodiment. The tube blank 12' includes nine side panels 46*a-i*. The side panels 46*a-i* are separated by respective fold lines 48*a-h*. The widths W, W' of the side panels 46*a-g* generally correspond with the width of the respective sides (e.g., sides 120*a-g* of FIG. 2B) of the bottom panel (e.g., bottom panel 116 of FIG. 2B). The combined width of the endmost side panels 46*h* and 46*i* is slightly greater than the width of the side 120*h* of the bottom panel 116. Thus, when the container assembly 10 (FIG. 1) is assembled, the side panels 46*h*, 46*i* slightly overlap such that they may be readily adhered to one another.

In the embodiment of FIG. 3, the tube blank 12' is made of a single-wall corrugated fiberboard and includes optional internal reinforcement in the form of a plurality of internal straps 50*a-d* positioned between one of the liner boards and the fluted or corrugated material. The internal straps 50*a-d* may be formed of sesame tape or any other suitable material. It is also contemplated that a different number (i.e., none, one, two, three, or more than four) of internal straps may be used for the tube blank 12'.

According to the embodiments described herein, a generally water-resistant coating is applied to at least a portion of the base blank (e.g., base blank 114' of FIG. 2B) and the tube blank 12'. For example, the water-resistant coating may be applied to an exterior surface (e.g., the surface that contacts articles inside of the container assembly) of an inner fiberboard layer of the base blank 114' and the tube blank 12' using any suitable coating technique. In some embodiments, the coating is applied to the inner fiberboard layer prior to forming the blanks. In some embodiments, the generally water-resistant coating is generally waterproof. In some embodiments, one or more additional coatings may be applied to the base blank 114' and/or the tube blank 12' to assist in ensuring that the base blank 114' and/or tube blank 12' are generally water-resistant.

Figure 4A:
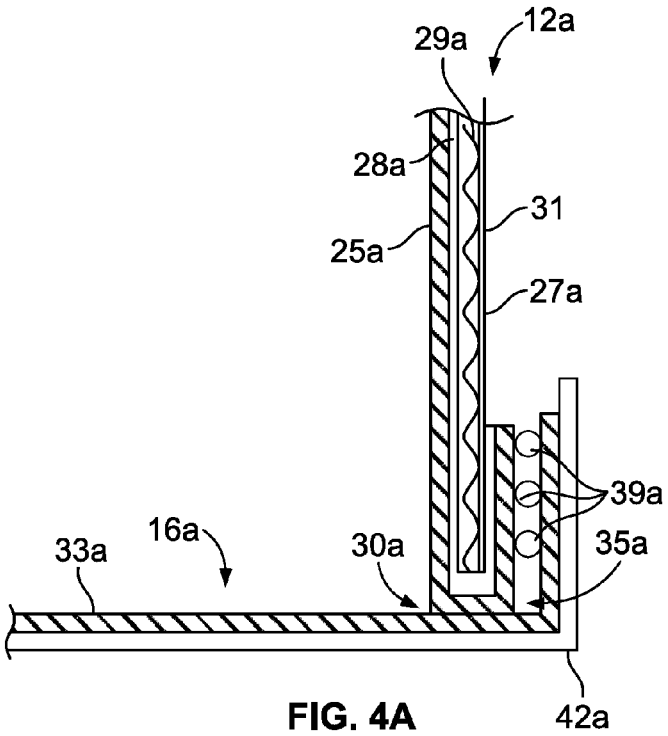
FIG. 4A is a cross-sectional view taken generally along line 4-4 of the container of FIG. 1, according to one embodiment.
Figure 4B:
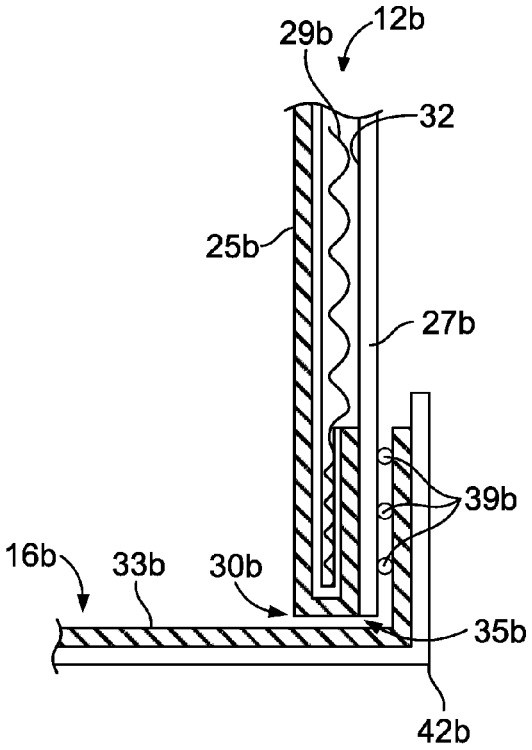
FIG. 4B is a cross-sectional view taken generally along line 4-4 of the container of FIG. 1, according to another embodiment.
Figure 4C:
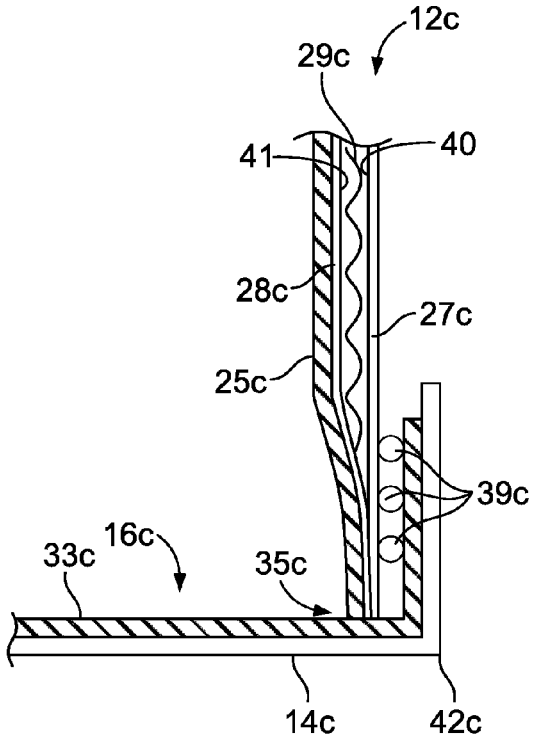
FIG. 4C is a cross-sectional view taken generally along line 4-4 of the container of FIG. 1, according to yet another embodiment.

FIGS. 4A-4C illustrate cross-sectional views of the tube portion 12 and the base portion 14 of FIG. 1 having coatings 25 applied thereto, according to various non-limiting examples. Specifically, FIGS. 4A-4C illustrate examples of sealing the "flute tips," or the ends of the corrugated layer, of the tube portion 12 such that liquid from the contents of the container assembly 10 cannot migrate therethrough. The tube portion 12 of the illustrated embodiments is formed of an outer fiberboard layer 27, an inner fiberboard layer 28 with a coating 25 applied thereto, and a corrugated layer 29 sandwiched therebetween. It is contemplated that additional layers may be used, e.g., to increase the strength of the resulting container assembly 10.

Referring to the non-limiting embodiment of FIG. 4A, a bottom end 30*a* of the coated inner fiberboard layer 28*a* is longer than the corrugated layer 29*a* and the outer fiberboard layer 27*a* such that the coated inner fiberboard layer 28*a* extends beyond and wraps around a bottom end 35*a* of the corrugated layer 29*a* and the outer fiberboard layer 27*a*. The bottom end 30*a* of the coated inner fiberboard layer 28*a* is adhered to an exterior surface 31 of the outer fiberboard layer 27*a*.

In the embodiment of FIG. 4B, the bottom end 30*b* of the coated inner fiberboard layer 29*b* extends beyond and wraps around the bottom end 35*b* of the corrugated layer 29*b* and the outer fiberboard layer 27*b*. The bottom end of the inner fiberboard layer 28*b* is adhered to an interior surface 32 of the outer fiberboard layer 27*b*.

In the embodiment of FIG. 4C, the corrugated layer 29*c* is shortened, e.g., does not extend all the way to the bottom 35*c* of the tube portion 12*c*. An interior surface 40 of the outer fiberboard layer 27*c* and an interior surface 41 of the coated inner fiberboard layer 28*c* are bonded together using any suitable technique.

The base portion 14 of the container assembly 10 described herein also includes a generally water-resistant bottom coating 33. According to one embodiment, the water-resistant bottom coating is applied to the exterior surface of an inner fiberboard layer during the formation of the base blank (e.g., base blank 114'). For example, a corrugated layer may be sandwiched between an interior surface of a coated, inner fiberboard layer and an interior surface of a second, outer fiberboard layer. A base blank 114' may then be cut from the resulting structure. As such, the generally water-resistant coating 33 covers substantially all of the interior side 145 of the base blank 114'.

Water-resistant coatings, as described herein, are desirable because they may eliminate plastic liners/poly bags in CBCs or other containers used to store or ship wet products. As such, they assist in reducing labor and costs associated with forming the containers. In some embodiments, at least the surface (e.g., the lining) of the coating includes one or more non-toxic materials including. The non-toxic materials may, in some embodiments, be safe and approved for contacting food products.

Figure 5:
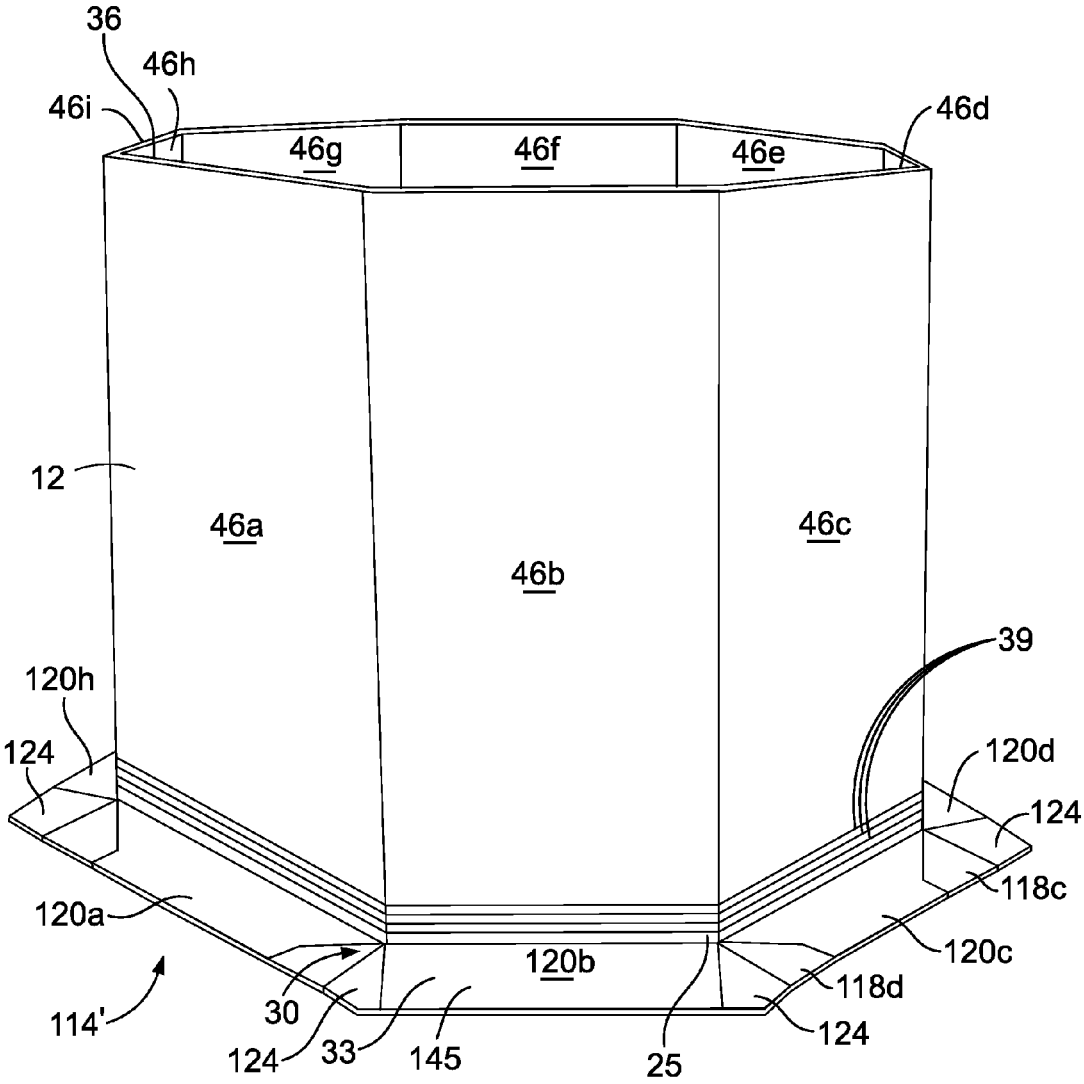
FIG. 5 is an isometric view illustrating the container assembly of FIG. 1 being formed, according to one embodiment.
Figure 6:
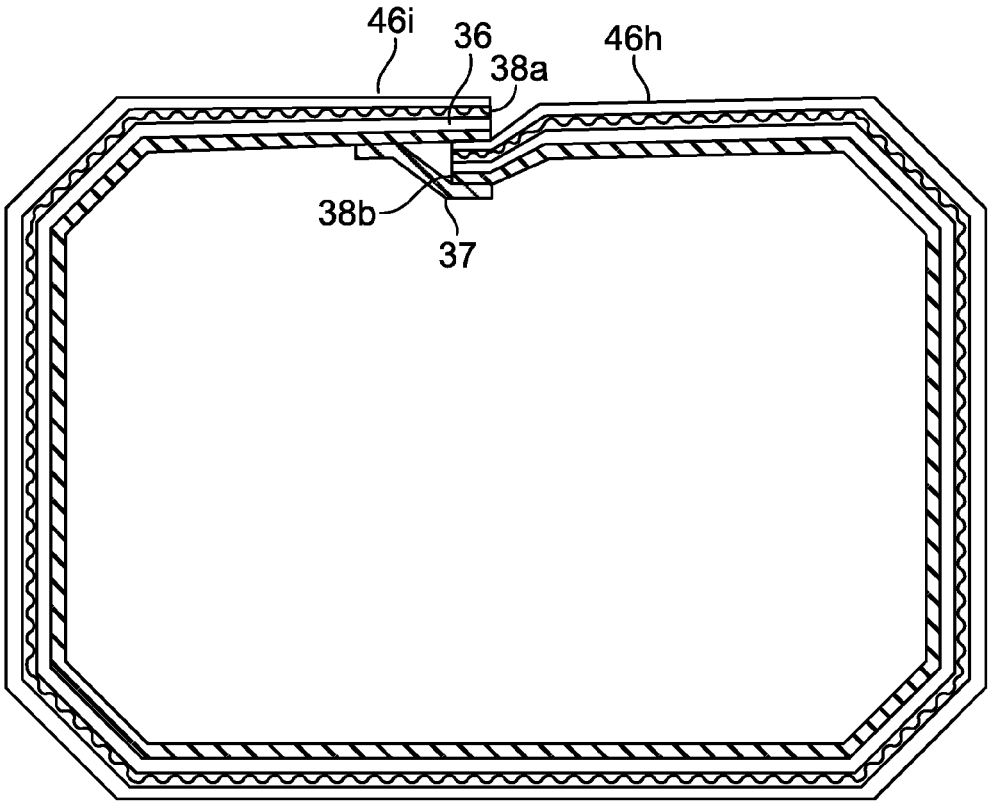
FIG. 6 is a top, cross-sectional view taken generally along line 6-6 of the container of FIG. 1.
Figure 7:
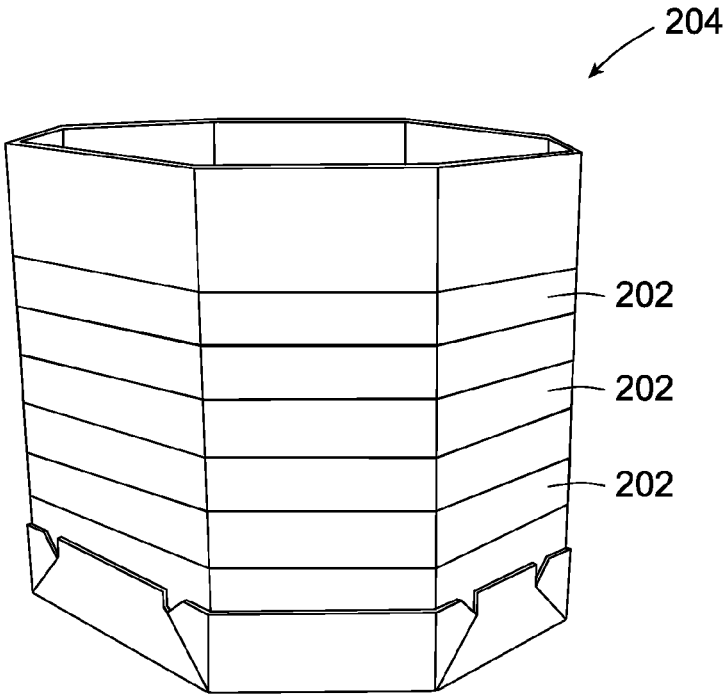
FIG. 7 is an isometric view of a container assembly according to yet another embodiment of the present invention.

The container assemblies of the embodiments described herein may be assembled using the base blank having a coating applied thereto and a tube blank having a coating applied thereto. To do so, the tube blank (e.g., tube blank 12' of FIG. 3) may be formed into an octagonal shape such that the endmost side panels 46*h*, 46*i* are aligned and at least partly flush with one another to form a standard corrugated manufacturing joint or seam 36 (see FIGS. 5 and 6). The endmost side panels 46*h*, 46*i* may then be attached to one another using any suitable means such as adhesive. The resulting tube portion 12 is shown in FIGS. 1 and 5, with a top, cross-sectional view shown in FIG. 6. The seam 36 may be made generally water-resistant, for example, by applying a generally waterproof adhesive (e.g., packaging tape or the like) over the seam 35 to effectively seal the seam 35 closed. Alternatively, the seam 36 may be made water-resistant by applying a wax-impregnated medium, a hot-melt adhesive, or a wick-resistant medium, by rolling the edge, or the like. In this way, the open ends 38*a*, 38*b* (FIG. 6) of the side panels 46*h*, 46*i* are not exposed to the contents of the resulting container assembly 10. As such, liquid inside the resulting container assembly 10 cannot migrate within the fiberboard and/or corrugated layers, thereby weakening the container assembly 10 or even causing it to fail.

As shown in the embodiments of FIG. 4A-4C and 5, at least one continuous adhesive line 39 is applied around the perimeter of the tube portion 12 at or near of a bottom end 30 thereof. One or more adhesive lines may also or alternatively be applied to the flaps 20*a-h*, 120*a-h* of the base blank 14', 114'. In the non-limiting embodiment shown in FIGS. 4A-4C and 5, the tube portion 12 includes three continuous, horizontal adhesive lines 39, which are generally parallel to one another.

The continuous adhesive lines 39 assist in ensuring that liquid in the bottom of the resulting container assembly 10 will not seep up through any gaps formed between the tube portion 12 and the panels of the base portion 14. Applying more than one adhesive line 39 may be desirable so that if one of the adhesive lines 39 is discontinuous at any point, any liquid that seeps through the discontinuity or gap in that line of adhesive will be trapped by a second line of adhesive applied above the first.

It is contemplated that any suitable number of adhesive lines may be used. For example, one, two, or more adhesive lines may be applied. Referring, for example, to FIG. 2B, in one embodiment, one or more adhesive lines may be applied to the interior sides 145 of the flaps 120*a-h* and the bellows panels 118*a-h* of the base blank 114'.

As shown in FIG. 5, to form the container assembly 10 of FIG. 1, the assembled tube portion 12 is placed over the bottom panel of the base blank (e.g., base blank 114' of FIG. 2B) with the coating 33 applied thereto such that each of the side panels 46*a-g* of the tube portion 12 is adjacent to each of the respective flaps 120*a-g* of the base blank 114'. The overlapping side panels 46*h*, 46*i* are adjacent to the flap 120*h*. Each flap 120*a-h* is then folded toward the tube portion 12 along its respective fold line 121*a-h* (see FIG. 2B) such that the interior sides 145 of the flaps 120*a-h* contact and adhere to the respective side panels 46*a-i* via the adhesive lines 39. The bellows panels 118*a-h* are folded along their respective fold lines 122, 124 and adhered to the adjacent side panels 46 of the tube portion 12 via the adhesive lines 39.

The resulting double thickness of the container assembly 10 of the embodiments described herein reinforces the corners and vertical scores of the container assembly 10. The integrity of the lower portion of the container assembly 10 is, thus, significantly reinforced, thereby improving the overall strength of the container assembly 10.

Although the illustrated embodiments show generally water-resistant coatings being applied to an octagonal-shaped two-piece container assembly 10, it is contemplated that the generally water-resistant coatings described herein may be applied to any suitable two-piece container assembly. For example, the generally water-resistant coatings described herein may be applied to a two-piece container assembly having three, four, five, six, seven, nine, or more sides.

The tube portion (e.g., tube portion 12 of FIG. 1) and the base portion (e.g., base portion 14 of FIG. 1) of the container assemblies described herein may be formed from a single-wall or a double-wall corrugated fiberboard. Alternatively, one of the tube portion 12, and the base portion 14 may be formed from a single-wall corrugated fiberboard and the other of the tube portion and the base portion 14 may be formed from a double-wall corrugated fiberboard. In one embodiment, for example, the tube portion 12 is single-wall corrugated fiberboard and the base portion 14 is double-wall corrugated fiberboard. This may be desirable since the majority of the weight of the contents of the container assembly (e.g., container assembly 10 of FIG. 1) is supported by the base portion 14. Because the tube portion 12 may be formed from a single-wall corrugated fiberboard without significantly decreasing the strength of the container assembly 10, the cost of manufacturing such a container assembly may be substantially reduced.

The container assemblies of the embodiments described herein may be assembled using any suitable means. For example, it is contemplated that assembly of the container assemblies of the embodiments described herein may be fully (or nearly fully) automated. In one embodiment, for example, a tube portion (e.g., tube portion 12 of FIG. 3) having endmost side panels 46*h,i* already attached may be brought in through extended glue heads and popped open. An operator may then load the tube portion 12 and the base portion 14 into a magazine that erects the tube portion 12 and laminates the base portion 14 to the tube portion 12 (e.g., as discussed above using continuous adhesive lines) to produce a fully automated container assembly.

In yet another embodiment, the process of forming a container assembly of the embodiments of the present invention is partially automated. In this embodiment, the tube portion 12 (e.g., tube portion 12 of FIG. 1) may be manually erected. A machine may apply one or more rows of adhesive lines to the flaps 20*a-h* of the base portion 14 and/or a bottom region of the tube portion 12. The machine may then fold the flaps 20*a-h* of the base portion 15 upward toward the tube portion 12, attaching the flaps 20*a-h* to the bottom region of the tube portion 12.

In yet another embodiment, the container assemblies of the embodiments described herein are manually assembled. In this embodiment, the tube portion (e.g., tube portion 12 of FIG. 1) is assembled such that the endmost side panels 46*h,i* of the tube portion 12 are adhered to one another. A fixture insert may then be inserted into the tube portion 12 to maintain the shape of the tube portion 12. The tube portion 12 is then set on top of the base blank 14'. One or more operators may then apply one or more rows of continuous, horizontal adhesive lines on the flaps 20*a-h* of the base blank 14' and/or on a bottom region of the tube portion 14 and fold the flaps 20*a-h* such that the flaps 20*a-h* attach to the tube portion 12.

Although not required or necessary, any of the container assemblies of the embodiments of the present invention may include one or more external reinforcement straps 202, as shown in a container assembly 204 of FIG. 10. The reinforcement strap 202 may be a single, generally seamless reinforcement strap continuously wound around a periphery of the container assembly 204. Non-limiting examples of materials that may be utilized for the reinforcement strap 202 include reinforced packaging tape, adhesive tape, polymeric film, and stretch polymeric string. Although in the embodiment of FIG. 10, three reinforcing straps 202 are shown, it is contemplated that any suitable number of reinforcing straps may be used.

In view of the generally water-resistant coatings applied to at least the interiors of the tube portion 12 and the base portion 14 and the ends thereof, the use of separate poly bags or liners for inhibiting or preventing liquid from the contents of the container assembly from damaging the integrity of the container assembly may be reduced or eliminated. This is beneficial from manufacturing, cost, and environmental standpoints.

According to alternative embodiment A, a container assembly includes a tube portion including a plurality of sides formed from an inner fiberboard layer, an outer fiberboard layer, and at least one corrugated layer sandwiched therebetween. An internal surface of the inner fiberboard layer has a first generally water-resistant coating. The inner fiberboard layer extends around a bottom of the corrugated layer and is adhered to at least a portion of the outer fiberboard layer. The container assembly further includes a base portion including a bottom panel and a plurality of flaps extending from the bottom panel. The base portion includes a second generally water-resistant coating. The plurality of flaps overlaps a portion of the plurality of sides. The plurality of flaps is adhered to respective ones of the plurality of sides by one or more continuous adhesive lines.

According to alternative embodiment B, the container assembly of alternative embodiment A, wherein the inner fiberboard layer is adhered to an interior surface of the outer fiberboard layer.

According to alternative embodiment C, the container assembly of alternative embodiment A, wherein the inner fiberboard layer is adhered to an exterior surface of the outer fiberboard layer.

According to alternative embodiment D, the container assembly of alternative embodiment A, wherein at least the surface of the coating is formed of one or more materials safe for contacting food.

According to alternative embodiment E, the container assembly of alternative embodiment A, wherein the plurality of sides and the plurality of flaps is greater than four.

According to alternative embodiment F, the container assembly of alternative embodiment A, wherein the plurality of sides further includes one or more additional fiberboard layer and one or more additional corrugated layers positioned between the inner and outer fiberboard layers.

According to alternative embodiment G, the container assembly of alternative embodiment A, wherein the base portion is formed from at least one inner fiberboard layer including the second generally water-resistant coating, at least one outer fiberboard layer, and at least one corrugated layer sandwiched therebetween.

According to alternative embodiment H, the container assembly of alternative embodiment G, wherein the base portion has a maximum caliber of about 3/16 inches.

According to alternative embodiment I, the container assembly of alternative embodiment A, wherein the base portion includes a plurality of bellows panels provided between each of the plurality of flaps.

According to alternative embodiment J, the container assembly of alternative embodiment A, wherein each of the bellows panels includes a crease or folding line at or near the center of the bellows panel.

According to alternative process K, a method of forming a container assembly is disclosed. The method includes adhering a first side of a tube portion to a second, opposing side of the tube portion. The tube portion is formed from an inner fiberboard layer, an outer fiberboard layer, and at least one corrugated layer sandwiched therebetween. The inner fiberboard layer includes a first generally water-resistant coating. The inner fiberboard layer extends around a bottom of the corrugated layer and is adhered to at least a portion of the outer fiberboard layer. The method further includes providing a base portion having a bottom panel. The bottom panel has a plurality of flaps extending therefrom. The base portion includes a second generally water-resistant coating extending from the bottom panel to at least a portion of the plurality of flaps. The plurality of flaps overlaps a portion of the plurality of sides. The method further includes placing the tube portion over the base portion. The method further includes folding the plurality of flaps along fold lines, the fold lines separating the plurality of flaps from the bottom panel. The method further includes attaching each of the plurality of flaps to a respective one of the plurality of sides of the tube portion by at least one continuous, generally horizontal adhesive line positioned along at least one of a lower portion of the tube portion and the flaps.

According to alternative process L, the process of alternative embodiment K, wherein the coating is adhered to an interior surface of the outer fiberboard layer.

According to alternative process M, the process of alternative embodiment K, wherein the coating is adhered to an exterior surface of the outer fiberboard layer.

According to alternative process N, the process of alternative embodiment K, wherein the coating is formed of one or more non-toxic materials.

According to alternative process O, the process of alternative embodiment K, wherein the plurality of sides and the plurality of flaps is greater than four.

According to alternative process P, the process of alternative embodiment K, wherein the plurality of sides further include one or more additional fiberboard layer and one or more additional corrugated layers positioned between the inner and outer fiberboard layers.

According to alternative process Q, the process of alternative embodiment K, wherein the base portion has a maximum caliber of about 3/16 inches.

According to alternative process R, the process of alternative embodiment K, wherein the base portion includes a plurality of bellows panels provided between each of the plurality of flaps.

According to alternative process S, the process of alternative embodiment R, wherein each of the bellows panels includes a crease or folding line at or near the center of the bellows panel.

According to alternative embodiment T, a container assembly is disclosed. The container assembly includes a tube portion including a plurality of sides formed from an inner fiberboard layer, an outer fiberboard layer, and at least one corrugated layer sandwiched therebetween. The corrugated layer is shortened such that the inner and outer fiberboard layers are directly adhered to one another at bottom ends of the plurality of sides. The inner fiberboard layer includes a first generally water-resistant coating. The container assembly further includes a base portion including a bottom panel and a plurality of flaps extending from the bottom panel. The base portion includes a second generally water-resistant coating extending from the bottom panel to at least a portion of the plurality of flaps. The plurality of flaps overlaps a portion of the plurality of sides. The plurality of flaps is adhered to respective ones of the plurality of sides by one or more continuous adhesive lines.

According to alternative embodiment U, the container assembly of alternative embodiment U, wherein the base portion includes a plurality of bellows panels provided between each of the plurality of flaps.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A container assembly comprising:

a tube portion including a plurality of sides formed from an inner fiberboard layer, an outer fiberboard layer, and at least one corrugated layer sandwiched therebetween, an internal surface of the inner fiberboard layer having a first generally water-resistant coating, the inner fiberboard layer extending around a bottom of the corrugated layer and being adhered to at least a portion of the outer fiberboard layer; and a base portion including a bottom panel and a plurality of flaps extending from the bottom panel, the base portion including a second generally water-resistant coating, the plurality of flaps overlapping a portion of the plurality of sides, wherein the plurality of flaps is adhered to respective ones of the plurality of sides by one or more continuous adhesive lines.

2. The container assembly of claim 1, wherein the inner fiberboard layer is adhered to an interior surface of the outer fiberboard layer.

3. The container assembly of claim 1, wherein the inner fiberboard layer is adhered to an exterior surface of the outer fiberboard layer.

4. The container assembly of claim 1, wherein at least the surface of the coating is formed of one or more materials safe for contacting food.

5. The container assembly of claim 1, wherein the plurality of sides and the plurality of flaps is greater than four.

6. The container assembly of claim 1, wherein the plurality of sides further includes one or more additional fiberboard layer and one or more additional corrugated layers positioned between the inner and outer fiberboard layers.

7. The container of claim 1, wherein the base portion is formed from at least one inner fiberboard layer including the second generally water-resistant coating, at least one outer fiberboard layer, and at least one corrugated layer sandwiched therebetween.

8. The container of claim 7, wherein the base portion has a maximum caliber of about 3/16 inches.

9. The container of claim 1, wherein the base portion includes a plurality of bellows panels provided between each of the plurality of flaps.

10. The container assembly of claim 9, wherein each of the bellows panels includes a crease or folding line at or near the center of the bellows panel.

11. A method of forming a container assembly comprising the acts of:

adhering a first side of a tube portion to a second, opposing side of the tube portion, the tube portion being formed from an inner fiberboard layer, an outer fiberboard layer, and at least one corrugated layer sandwiched therebetween, the inner fiberboard layer including a first generally water-resistant coating, the inner fiberboard layer extending around a bottom of the corrugated layer, and being adhered to at least a portion of the outer fiberboard layer;

providing a base portion having a bottom panel, the bottom panel having a plurality of flaps extending therefrom, the base portion including a second generally water-resistant coating extending from the bottom panel to at least a portion of the plurality of flaps, the plurality of flaps overlapping a portion of the plurality of sides;

placing the tube portion over the base portion;

folding the plurality of flaps along fold lines, the fold lines separating the plurality of flaps from the bottom panel; and attaching each of the plurality of flaps to a respective one of the plurality of sides of the tube portion by at least one continuous, generally horizontal adhesive line positioned along at least one of a lower portion of the tube portion and the flaps.

12. The method of claim 11, wherein the coating is adhered to an interior surface of the outer fiberboard layer.

13. The method of claim 11, wherein the coating is adhered to an exterior surface of the outer fiberboard layer.

14. The method of claim 11, wherein the coating is formed of one or more non-toxic materials.

15. The method of claim 11, wherein the plurality of sides and the plurality of flaps is greater than four.

16. The method of claim 11, wherein the plurality of sides further include one or more additional fiberboard layer and one or more additional corrugated layers positioned between the inner and outer fiberboard layers.

17. The method of claim 11, wherein the base portion has a maximum caliber of about 3/16 inches.

18. The method of claim 11, wherein the base portion includes a plurality of bellows panels provided between each of the plurality of flaps.

19. The method of claim 18, wherein each of the bellows panels includes a crease or folding line at or near the center of the bellows panel.

20. A container assembly comprising:

a tube portion including a plurality of sides formed from an inner fiberboard layer, an outer fiberboard layer, and at least one corrugated layer sandwiched therebetween, the corrugated layer being shortened such that the inner and outer fiberboard layers are directly adhered to one another at bottom ends of the plurality of sides, the inner fiberboard layer including a first generally water-resistant coating; and a base portion including a bottom panel and a plurality of flaps extending from the bottom panel, the base portion including a second generally water-resistant coating extending from the bottom panel to at least a portion of the plurality of flaps, the plurality of flaps overlapping a portion of the plurality of sides, wherein the plurality of flaps is adhered to respective ones of the plurality of sides by one or more continuous adhesive lines.

21. The container of claim 20, wherein the base portion includes a plurality of bellows panels provided between each of the plurality of flaps.

* * * * *